US005542139A

United States Patent [19]

Boivin

[11] Patent Number: 5,542,139

[45] Date of Patent: Aug. 6, 1996

[54] MULTI-PURPOSE TOOL FOR CUTTING, PRYING AND PUNCHING IN THE EVENT OF AN EMERGENCY SITUATION

[76] Inventor: Gregory E. Boivin, 253 Flanders Rd., #3, Niantic, Conn. 06357

[21] Appl. No.: 360,169

[22] Filed: Dec. 20, 1994

[51] Int. Cl.[6] ..... B26B 11/00

[52] U.S. Cl. ..... 7/118; 7/100; 30/155; 87/20

[58] Field of Search ..... 7/100, 118, 158, 7/170; 30/155; 81/20

[56] References Cited

U.S. PATENT DOCUMENTS

| | | | |
|---|---|---|---|
| 4,187,607 | 2/1980 | Simuro et al. | 7/118 X |
| 4,805,303 | 2/1989 | Gibbs | 7/118 X |
| 5,251,351 | 10/1993 | Klotz | 7/100 |

*Primary Examiner*—James G. Smith

[57] ABSTRACT

A multi-purpose tool for cutting, prying and punching in the event of an emergency situation comprising a handle having a pair of similarly shaped handle halves each with a plurality of end apertures and a center aperture extending therethrough in axial alignment for being coupled together for operation and use; a first part formed as a blade having a cutting end and a support end; a second part formed as a punch having a housing end and a support end; a plurality of spacers between the housing halves and the adjacent parts and between the adjacent parts with apertures at ends and center for coupling the housing halves and the parts and the spacers; and a plurality of fasteners extending through the apertures of the housing halves to couple together the housing halves, spacers and parts for movement between interior inoperative positions and exterior operative positions.

1 Claim, 4 Drawing Sheets

MULTI-PURPOSE TOOL FOR CUTTING, PRYING AND PUNCHING IN THE EVENT OF AN EMERGENCY SITUATION

BACKGROUND OF THE INVENTION

1. Field of the Invention

The present invention relates to a multi-purpose tool for cutting, prying and punching in the event of an emergency situation and more particularly pertains to cutting a material such as seat belts, prying apart coupled together surfaces and punching open windows through the use of a two-part tool.

2. Description of the Prior Art

The use of tools for cutting and/or prying and/or punching of a wide variety of designs and configurations is known in the prior art. More specifically, tools for cutting and/or prying and/or punching of a wide variety of designs and configurations heretofore devised and utilized for the purpose of cutting various surfaces with a knife, prying open objects as needed and punching holes in glass or the like through a wide variety of tools, blades and the likes of various constructions and configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,730,394 a folding camp knife.

U.S. Pat. No. 4,805,303 discloses a multi-blade folding knife with lock open feature.

U.S. Pat. No. 4,897,922 discloses a folding knife.

U.S. Pat. No. 5,029,355 discloses a folding utility tool.

U.S. Patent Des. Number discloses the design of a folding knife.

In this respect, the multi-purpose tool for cutting, prying and punching in the event of an emergency situation according to the present invention substantially departs from the conventional concepts and designs of the prior art, and in doing so provides an apparatus primarily developed for the purpose of cutting a material such as seat belts, prying apart coupled together surfaces and punching open windows through the use of a two-part tool.

Therefore, it can be appreciated that there exists a continuing need for a new and improved multi-purpose tool for cutting, prying and punching in the event of an emergency situation which can be used for cutting a material such as seat belts, prying apart coupled together surfaces and punching open windows through the use of a two-part tool. In this regard, the present invention substantially fulfills this need.

SUMMARY OF THE INVENTION

In view of the foregoing disadvantages inherent in the known types of tools for cutting and/or prying and/or punching of a wide variety of designs and configurations now present in the prior art, the present invention provides an improved multi-purpose tool for cutting, prying and punching in the event of emergency situations. As such, the general purpose of the present invention, which will be described subsequently in greater detail, is to provide a new and improved multi-purpose tool for cutting, prying and punching in the event of an emergency situation and method which has all the advantages of the prior art and none of the disadvantages.

To attain this, the present invention essentially comprises a new and improved multi-purpose tool for cutting, prying and punching in the event of an emergency situation comprising, in combination, a handle having a pair of similarly shaped handle halves each with a plurality of end apertures and a center aperture extending therethrough in axial alignment for being coupled together for operation and use; a first part formed as a blade having a cutting end and a support end, the support end having an aperture aligned with one end aperture of the housing halves, the blade having one elongated blunt surface and one elongated serrated cutting edge for cutting seat belts and the like, the cutting edge having a hook at its outboard end remote from the support end, the hook with an interior curved surface sharpened for cutting and having at the tip adjacent to the hook, a flat blunt surface for prying; a second part formed as a punch having a housing end and a support end with an aperture aligned with the aperture of the first blade and its associated end apertures of the handle halves, the housing end having a hole at its end remote from the support end with a pointed punch slidably secured within the housing and a spring within the housing between the inboard end of the housing and the inboard end of the punch whereby placing the housing with its hole adjacent the surface to be punched and allowing the spring to apply axial force to the punch will effect the forward movement of the punch through the hole to punch open the adjacent surface and, thereafter, the spring may be compressed to return the punch to its inoperative position within the housing; a locking pin extending through the housing at an intermediate location adapted to be shifted by an operator between a closed position wherein the pin locks the punch interior of the housing and an open position remote from the punch to allow its forward movement thereof under the expansion of the spring; a plurality of spacers between the housing halves and the adjacent parts and between the adjacent parts with apertures at ends and center for coupling the housing halves and the parts and the spacers; and a plurality of fasteners extending through the apertures of the housing halves to couple together the housing halves, spacers and parts for movement between interior inoperative positions and exterior operative positions.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multi-purpose tool for cutting, prying and punching in the event of an emergency situation which has all the advantages of the prior art tools for cutting and/or prying and/or punching of a wide variety of designs and configurations and none of the disadvantages.

It is another object of the present invention to provide a new and improved multi-purpose tool for cutting, prying and punching in the event of an emergency situation which may be easily and efficiently manufactured and marketed.

It is further object of the present invention to provide a new and improved multi-purpose tool for cutting, prying and punching in the event of an emergency situation which is of durable and reliable constructions.

An even further object of the present invention is to provide a new and improved multi-purpose tool for cutting, prying and punching in the event of an emergency situation which is susceptible of a low cost of manufacture with regard to both materials and labor, and which accordingly are then susceptible of low prices of sale to the consuming public, thereby making such multi-purpose tool for cutting, prying and punching in the event of an emergency situation economically available to the buying public.

Still yet another object of the present invention is to provide a new and improved multi-purpose tool for cutting, prying and punching in the event of an emergency situation which provides in the apparatuses and methods of the prior art some of the advantages thereof, while simultaneously overcoming some of the disadvantages normally associated therewith.

Still another object of the present invention is to cut a material such as seat belts, pry apart coupled together surfaces and punch open windows through the use of a two-part tool.

Lastly, it is an object of the present invention to provide new and improved multi-purpose tool for cutting, prying and punching in the event of an emergency situation comprising a handle having a pair of similarly shaped handle halves each with a plurality of end apertures and a center aperture extending therethrough in axial alignment for being coupled together for operation and use; a first part formed as a blade having a cutting end and a support end; a second part formed as a punch having a housing end and a support end; a plurality of spacers between the housing halves and the adjacent parts and between the adjacent parts with apertures at ends and center for coupling the housing halves and the parts and the spacers; and a plurality of fasteners extending through the apertures of the housing halves to couple together the housing halves, spacers and parts for movement between interior inoperative positions and exterior operative positions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
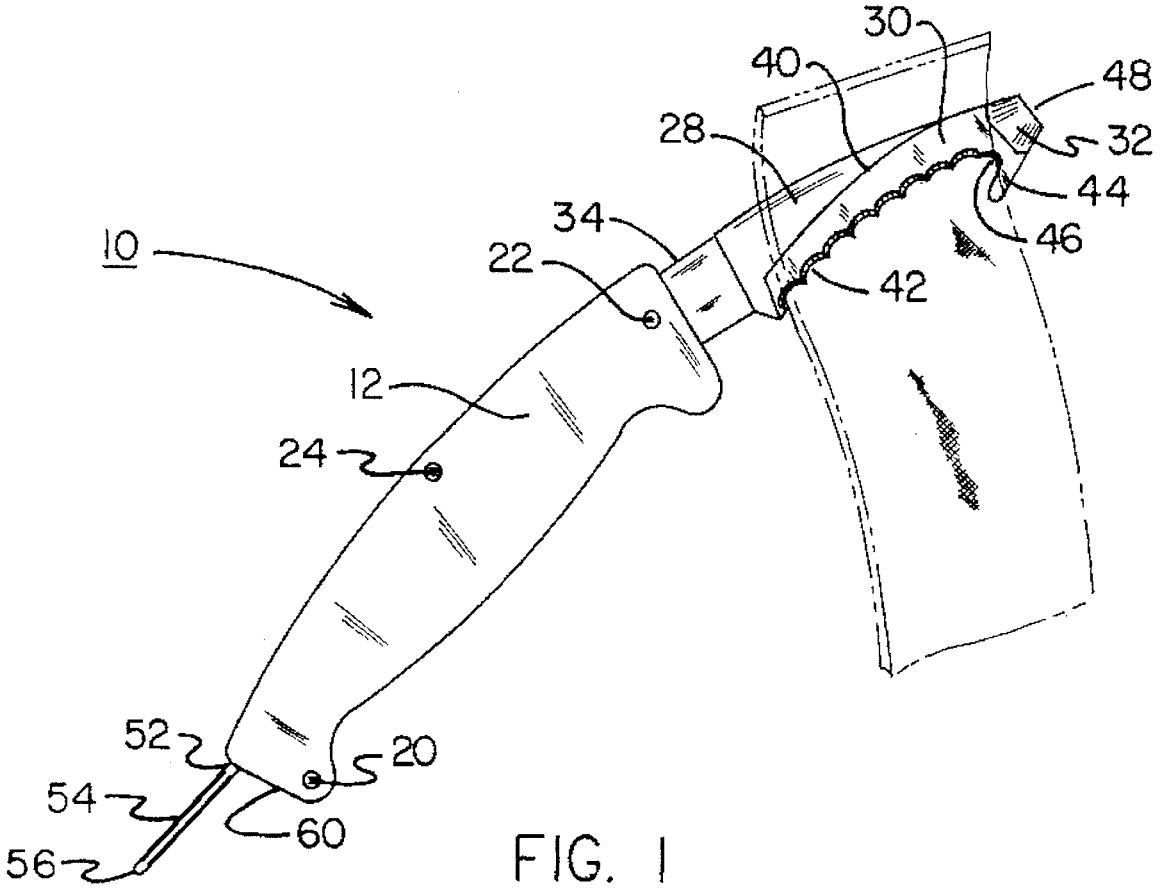
FIG. 1 is a perspective view of the preferred embodiment of the multi-purpose tool for cutting, prying and punching in the event of an emergency situation constructed in accordance with the principles of the present invention.
Figure 2:
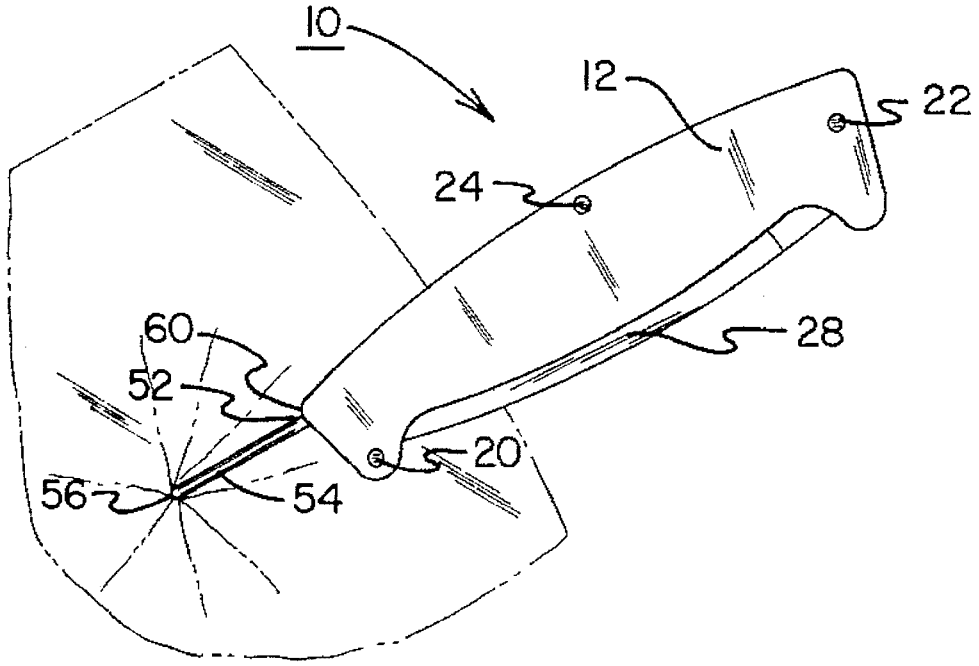
FIG. 2 is a perspective showing of the device illustrated in FIG. 1 but with an alternate part deployed.
Figure 3:
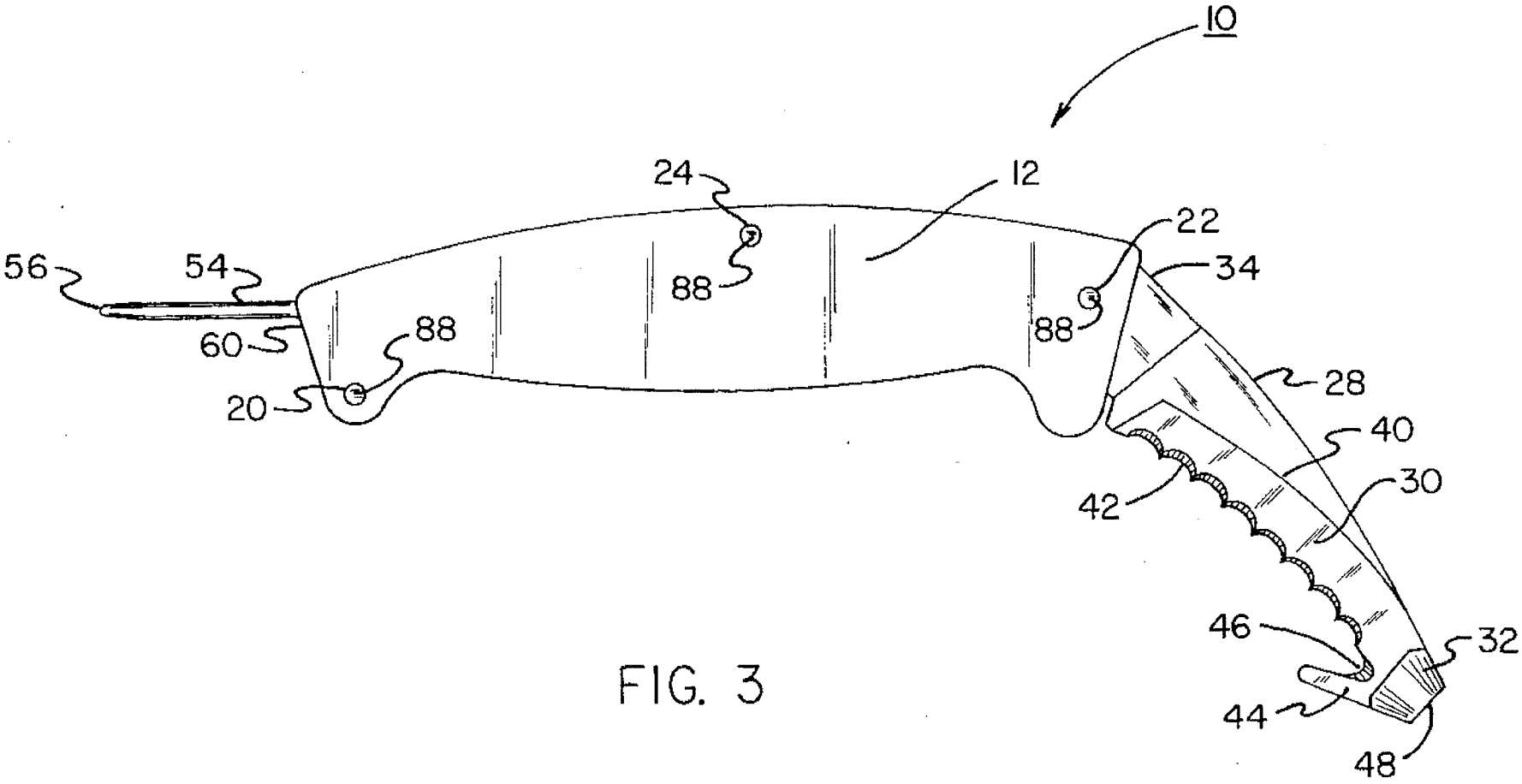
FIG. 3 is a front elevational view of the device of the prior Figures illustrating the two blades in various positions of deployment.

With reference now to the drawings, and in particular to FIG. 1 thereof, the preferred embodiment of the new and improved multi-purpose tool for cutting, prying and punching in the event of an emergency situation embodying the principles and concepts of the present invention and generally designated by the reference numeral 10 will be described.

The present invention, the new and improved multi-purpose tool for cutting, prying and punching in the event of an emergency situation comprised of a plurality of components. The system 10 of the present invention has components which, in their broadest context, include a handle, a first part, a second part, a first spring, a second spring, and a plurality of fasteners. Such components are individually configured and correlated with respect to each other so as to attain the desired objective.

More specifically, the central component of the present system 10 is a handle 12. Such handle is formed of a plurality of matingly configured shaped handle components 14, 16 and 18. Each of such components is formed with a plurality of end apertures 20 and 22 and a central aperture 24. Such apertures extend through the components and are in axial alignment. Such apertures are used for coupling together the handle components during operation and use.

The next component of the system 10 is a first part 28. Such first part is formed as a blade 30. The blade has a cutting end 32 and a support end 34. The support end has an aperture 36 aligned with one end aperture 22 of the housing components. The blade also has one elongated blunt surface 40 and one elongated serrated cutting edge 42. Such cutting edges are for cutting seat belts and the like in the event of an emergency.

The cutting edge of the first part is formed with a hook 44. Such hook is at its outboard end remote from the support end. The hook is formed with an interior curved surface 46. Such curved surface is sharpened for cutting purposes. Also formed on the first part at the tip end adjacent to the hook is a flat blunt surface 48 for prying.

The next component of the system is a second part 52. Such second part is formed as a punch 54. It has an outboard pointed end 56. It also has an inboard end 58. The punch is reciprocally secured within the handle. Its inboard end is located interior of the handle. Its outboard extends exterior of the handle on the end 60 thereof opposite from the first part.

The housing end with the second part is formed with the hole 64 at its end remote from the first part. Such punch is formed with a pointed end and is slidably secured within the hole. In addition, the trigger 66 is reciprocable within the handle. The trigger has an outboard end in contact with the inboard end of the punch. Formed integrally with the trigger is a rod 68 which extends inboardly thereof.

Next provided is a hammer 70. The hammer is reciprocally mounted within the handle adjacent to the rod. The hammer has a cylindrical recess 72 for receiving the rod. Also provided thereadjacent is an adjustment bolt 74. Its exterior end is provided with a slot 76 for adjustment purposes. Such bolt is located at the end of the handle adjacent to the first part. The coupling between the bolt and the receiving part of the handle are mating screw threads 78 which allow for axial adjustment of the bolt with rotation of the bolt through the slot to effect the pressure on the spring.

Next provided within the system 10 is a spring assembly. Such spring assembly includes a first spring 80 urging the trigger outwardly. The spring assembly also includes a second spring 84 between the hammer and the bolt. Such second spring functions to urge the hammer outboardly. With such an arrangement, the punch may be struck with its point against a glass to be broken in the event of an emergency. The relationship including the springs allows for a reduction in impact during such motion.

Figure 4:
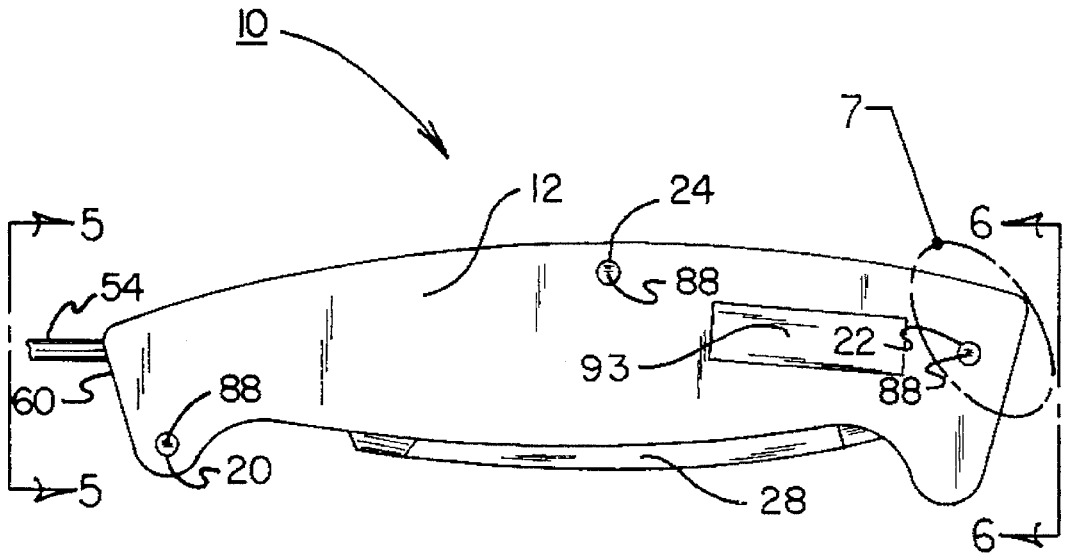
FIG. 4 is an exploded perspective view of the device of the prior Figure.
Figure 5:
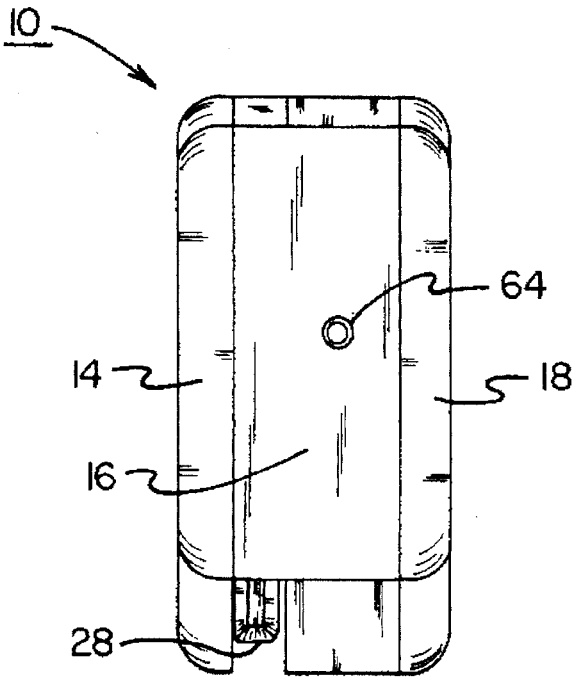
FIG. 5 is a cross-sectional view of one of the parts of the device shown in the prior Figure.
Figure 6:
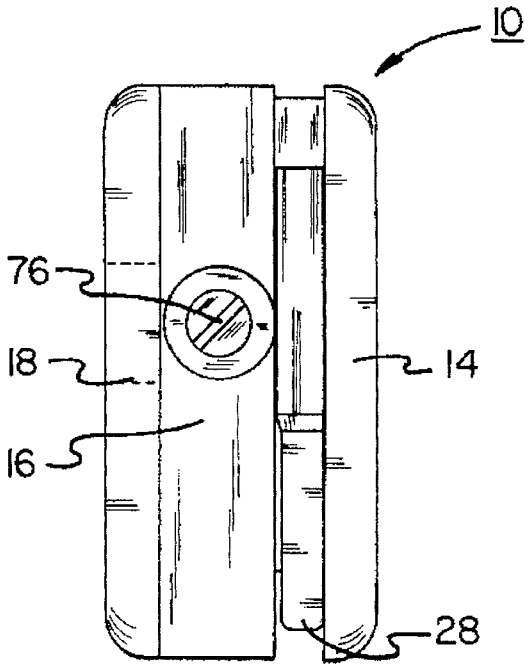
FIG. 6 is a cross-sectional view taken along lines 6—6 of FIG. 5.
Figure 8:
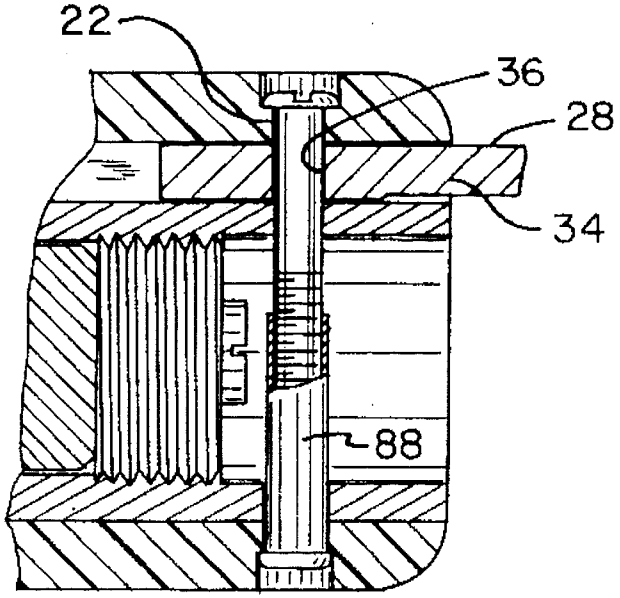
FIG. 8 is a cross-sectional view taken along line 8—8 of FIG. 7.
Figure 7:
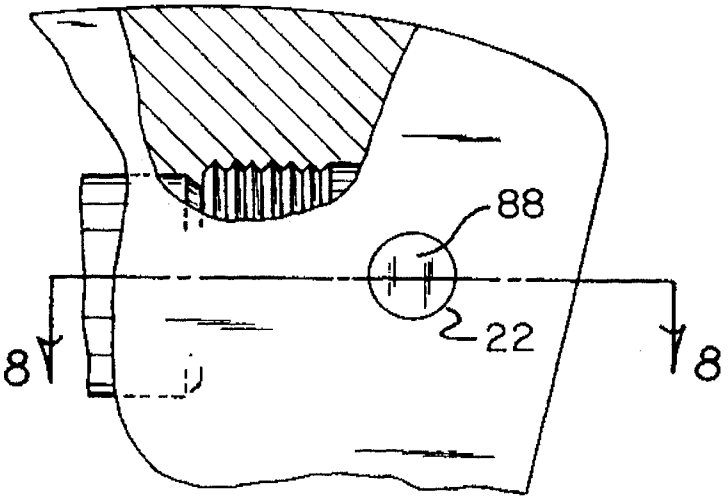
FIG. 7 is an enlarged view of the end of the device taken at oval of FIG. 4 but with parts removed to show certain internal constructions thereof.
Figure 9:
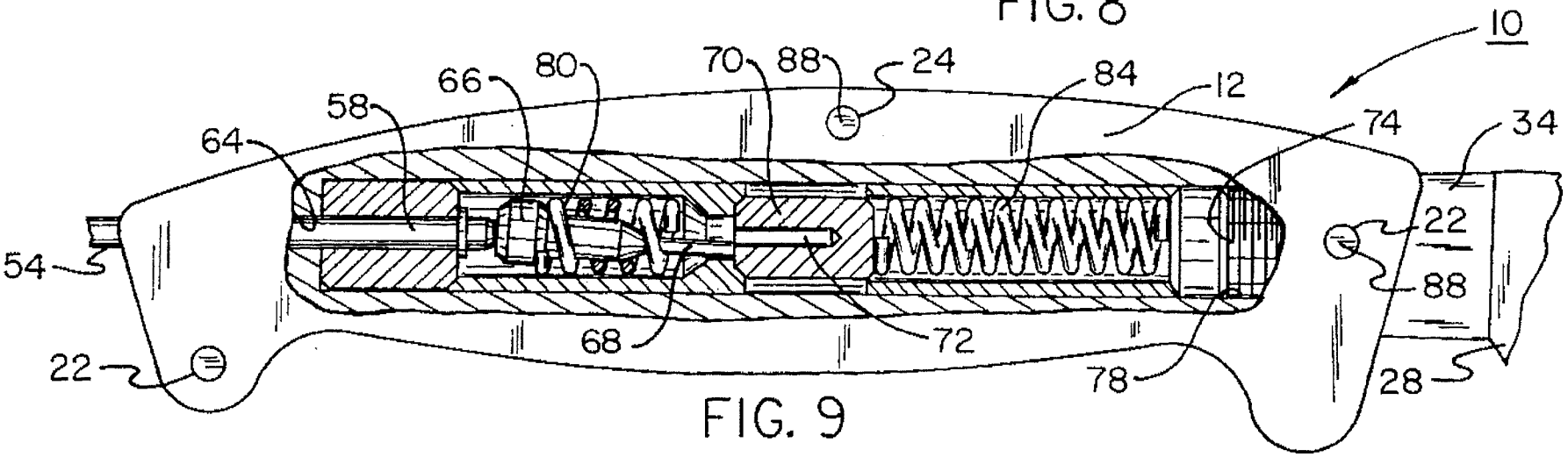
FIG. 9 is a side elevational view of the device similar to FIG. 4 but with parts removed to show certain internal constructions thereof.

One additional feature of the present invention is a rectangular box-like recess 93 formed into the exterior surface of the handle adjacent to one end. In the preferred embodiment, the recess 93 has a length of about 1¾ inches long, a width of about 17/32 inches and a depth of about 3/16 inches. Note FIGS. 4 and 6. The recess is adapted to receive the rectangular handle of a conventional house supply propane or natural gas shut off. The tool with such recess may then function as a wrench for more readily turning off the gas to a house in the event of a fire.

The present invention is a multi-purpose tool that is designed for use by people who respond to accidents and emergencies. It can be of great value to law enforcement officers, fire fighters, emergency vehicle and ambulance personnel, vehicle occupants, as well as to passerby who come upon an accident.

This handy tool can help to save lives because it contains three items which could assist in gaining access to people who may be injured or trapped in a vehicle. It is somewhat larger than small pocket knife, but can still be carried in a pocket, glove compartment, or emergency kit.

The present invention contains a blade which has serrations on the cutting edge to cut through a seat belt. Since seat belt material is rather thick and durable, the blade is substantial enough to allow a considerable force to be applied to cut through it quickly. For use in prying, the blade has a wide flat tip, above a hook-like recess. It also features a spring-loaded center punch which, when pressed against the surface of a window, automatically shatters the glass, enabling the user to gain ready access to a victim.

The first tool swings open for use by virtue of a pivot pin similar to a conventional pocket knife. The second tool is always available. The well-balanced invention is made of alloy steels which can be heat treated to obtain the desired characteristics for each function. A high strength plastic or metal housing encases the components when they are retracted and fits comfortably in the user's hand when any of the tools are used.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-purpose tool for cutting, prying and punching in the event of emergency situations comprising, in combination:

a handle with a first end and a second end, the first end having a blade aperture therethrough, the second end having a punch aperture therethrough, the handle having a plurality of matingly coupled handle components, the handle components having coupling apertures extending through the handle components in axial alignment for coupling the handle components together during operation and use;

a first part formed as a blade at the first end of the handle extending through the blade aperture and having a cutting end and a support end, the support end having an aperture aligned with one aperture of the handle components, the blade having one elongated blunt edge and one elongated serrated edge for cutting seat belts and the like, the serrated edge having an inboard end and an outboard end with a hook formed at the outboard end, the hook having an interior curved surface sharpened for cutting and the hook also having at the outboard end a flat blunt surface for prying;

a second part formed as a punch at the second end of the handle and extending through the punch aperture and having an outboard pointed end and an inboard end, the punch being reciprocally secured with respect to the handle with its inboard end interior of the handle and with its outboard end extending exterior of the handle;

a trigger located within the handle adjacent to the inboard end of the punch and reciprocable within the handle, the trigger having an inboard end and an outboard end in contact with the inboard end of the punch, the trigger also including a rod extending inboardly from the inboard end of the trigger;

a hammer reciprocally mounted within the handle adjacent to the rod and an adjustment bolt adjacent to the first end of the handle;

a first spring urging the trigger toward the second end;

a second spring urging the hammer toward the second end; and a plurality of fasteners extending through the coupling apertures of the handle components to couple together the handle components.

* * * * *